US011703296B2

(12) United States Patent
Fromholtz

(10) Patent No.: US 11,703,296 B2
(45) Date of Patent: Jul. 18, 2023

(54) MUZZLE BRAKE COMPENSATOR

(71) Applicant: Dustin Nicklaus Fromholtz, St. Francis, KS (US)

(72) Inventor: Dustin Nicklaus Fromholtz, St. Francis, KS (US)

( * ) Notice: Subject to any disclaimer, the term of this patent is extended or adjusted under 35 U.S.C. 154(b) by 0 days.

(21) Appl. No.: 17/391,700

(22) Filed: Aug. 2, 2021

(65) Prior Publication Data

US 2021/0356226 A1 Nov. 18, 2021

Related U.S. Application Data

(63) Continuation-in-part of application No. 17/151,299, filed on Jan. 18, 2021, now abandoned.

(60) Provisional application No. 62/968,209, filed on Jan. 31, 2020.

(51) Int. Cl.
*F41A 21/38* (2006.01)

(52) U.S. Cl.
CPC ..... *F41A 21/38* (2013.01)

(58) Field of Classification Search
CPC ..... F41A 21/32; F41A 21/325; F41A 21/34; F41A 21/36; F41A 21/38
See application file for complete search history.

(56) References Cited

U.S. PATENT DOCUMENTS 812,140 A * 2/1906 Kent ..... F41A 21/28 89/14.3
1,333,402 A * 3/1920 Galliot ..... F41A 21/36 89/14.3
1,390,658 A * 9/1921 Towson ..... F41A 21/38 89/14.3
1,429,619 A * 9/1922 Nelson ..... F41A 21/36 89/14.3
2,192,081 A * 2/1940 Hughes ..... F41A 21/36 89/14.3
2,212,683 A * 8/1940 Hughes ..... F41A 21/36 89/14.3
2,223,014 A * 11/1940 Galliot ..... F41A 21/36 89/14.3
2,667,815 A * 2/1954 Strong ..... F41A 21/36 89/14.3
3,152,510 A * 10/1964 Ashbrook ..... F41A 21/36 89/14.3

(Continued)

*Primary Examiner* — Derrick R Morgan

(74) *Attorney, Agent, or Firm* — Bennet K. Langlotz; Langlotz Patent & Trademark Works, LLC

(57) ABSTRACT

A muzzle brake compensator has a mount configured to connect to the barrel in registration with the barrel axis, a body defining an interior chamber and connected to the mount, the body defining a bullet aperture registered with the barrel axis, an exhaust port apart from the bullet aperture, a nozzle element connected to the exhaust port and rotatable about a port axis, and the nozzle element defining an exhaust aperture having an exhaust feature having a characteristic angularly offset from the port axis, such that the rotational position of the nozzle element determines a direction of an exhaust force with respect to the port axis. The nozzle element may protrude laterally at an angle from the barrel axis. The nozzle element may be lateral to the bullet aperture. A pair of exhaust ports may be located on laterally opposed positions with respect to the bullet aperture.

22 Claims, 4 Drawing Sheets

(56) References Cited

U.S. PATENT DOCUMENTS 3,368,453 A * 2/1968 Shaw ..... F41A 21/36 89/14.3
4,307,652 A * 12/1981 Witt ..... F41A 21/36 89/14.3
4,374,484 A * 2/1983 Bekker ..... F41A 21/325 89/14.3
5,036,747 A * 8/1991 McClain, III ..... F41A 21/36 89/14.3
5,092,223 A * 3/1992 Hudson ..... F41A 21/34 89/14.3
5,357,842 A * 10/1994 Reynolds ..... F41A 21/36 89/14.3
5,631,438 A * 5/1997 Martel ..... F41A 21/36 89/14.3
8,166,861 B2 * 5/2012 Peterson ..... F41A 21/36 89/14.3
9,163,891 B1 * 10/2015 Dater ..... F41A 21/34
9,303,939 B1 * 4/2016 Brinkmeyer ..... F41A 21/38
9,689,636 B2 * 6/2017 Randall ..... F41A 21/36
10,520,272 B1 * 12/2019 Carson ..... F41A 21/36
10,935,338 B1 * 3/2021 Kunau ..... F41A 21/34
2003/0084780 A1 * 5/2003 Rosenthal ..... F41A 21/28 89/14.3
2008/0173166 A1 * 7/2008 Andry ..... F41A 21/40 89/14.3
2010/0180758 A1 * 7/2010 Lessel ..... F41A 21/34 89/14.3
2011/0226121 A1 * 9/2011 Peterson ..... F41A 21/36 89/14.3
2015/0192379 A1 * 7/2015 Larson, Jr. ..... F41A 21/36 89/14.3
2016/0223281 A1 * 8/2016 Randall ..... F41A 21/36
2019/0128633 A1 * 5/2019 Cheng ..... F41A 21/38
2021/0164748 A1 * 6/2021 Griffitts ..... F41A 21/36
2021/0172694 A1 * 6/2021 Reel ..... F41A 21/32
2021/0356226 A1 * 11/2021 Fromholtz ..... F41A 21/38

* cited by examiner

MUZZLE BRAKE COMPENSATOR

CROSS-REFERENCE TO RELATED APPLICATION

This application is a Continuation-in-Part of U.S. patent application Ser. No. 17/151,299 filed on Jan. 18, 2021, entitled "MUZZLE BRAKE COMPENSATOR," which claims the benefit of U.S. Provisional Patent Application No. 62/968,209 filed on Jan. 31, 2020, entitled "Muzzle brake/Compensator," which are hereby incorporated by reference in their entirety for all that is taught and disclosed therein.

FIELD OF THE INVENTION

The present invention relates to firearms, and more particularly to a muzzle brake compensator that reduces firearm movements resulting from recoil when firing a bullet from a barrel.

BACKGROUND AND SUMMARY OF THE INVENTION

When a bullet is fired from the barrel of a firearm, recoil energy is generated by the propellant that travels rearward from the muzzle. This recoil energy is absorbed by either a person or apparatus holding the firearm. This recoil energy also causes the muzzle to rise. The rearward and upward movements combine to move the firearm off target. When firing at the same object, the firearm must be re-aimed toward the object. Excessive recoil can affect the accuracy and usefulness of a firearm by slowing follow up shots.

Muzzle brakes can be added to the muzzle of a firearm to direct the propellant gases and muzzle blast of a fired bullet away from shooter. Typically, this is at a 180° angle to the muzzle. While traditional muzzle brakes are somewhat successful at reducing recoil, they can make the firearm sound louder to the shooter or other shooters in proximity. Another disadvantage is traditional muzzle brakes do not reduce muzzle rise.

Therefore, a need exists for a new and improved muzzle brake compensator that reduces firearm movements resulting from recoil when firing a bullet from a barrel that exhausts propellant gases, muzzle blast, and sound away from the shooter and those in close proximity to the shooter. In this regard, the various embodiments of the present invention substantially fulfill at least some of these needs. In this respect, the muzzle brake compensator according to the present invention substantially departs from the conventional concepts and designs of the prior art, and in doing so provides an apparatus primarily developed for the purpose of reducing firearm movements resulting from recoil and muzzle blast when firing a bullet from a barrel, while still allowing muzzle gases and sound to exhaust in the normal direction away from the shooter or other shooters in proximity as occurs with a firearm with no muzzle device attached.

The present invention provides an improved muzzle brake compensator, and overcomes the above-mentioned disadvantages and drawbacks of the prior art. As such, the general purpose of the present invention, which will be described subsequently in greater detail, is to provide an improved muzzle brake compensator that has all the advantages of the prior mentioned above.

To attain this, the preferred embodiment of the present invention essentially comprises a mount configured to connect to the barrel in registration with the barrel axis, a body defining an interior chamber and connected to the mount, the body defining a bullet aperture registered with the barrel axis, an exhaust port apart from the bullet aperture, a nozzle element connected to the exhaust port and rotatable about a port axis, and the nozzle element defining an exhaust aperture having an exhaust feature having a characteristic angularly offset from the port axis, such that the rotational position of the nozzle element determines a direction of an exhaust force with respect to the port axis. The nozzle element may protrude laterally at an angle from the barrel axis. The nozzle element may be lateral to the bullet aperture. There may be a pair of exhaust ports. The exhaust ports may be located on laterally opposed positions with respect to the bullet aperture. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
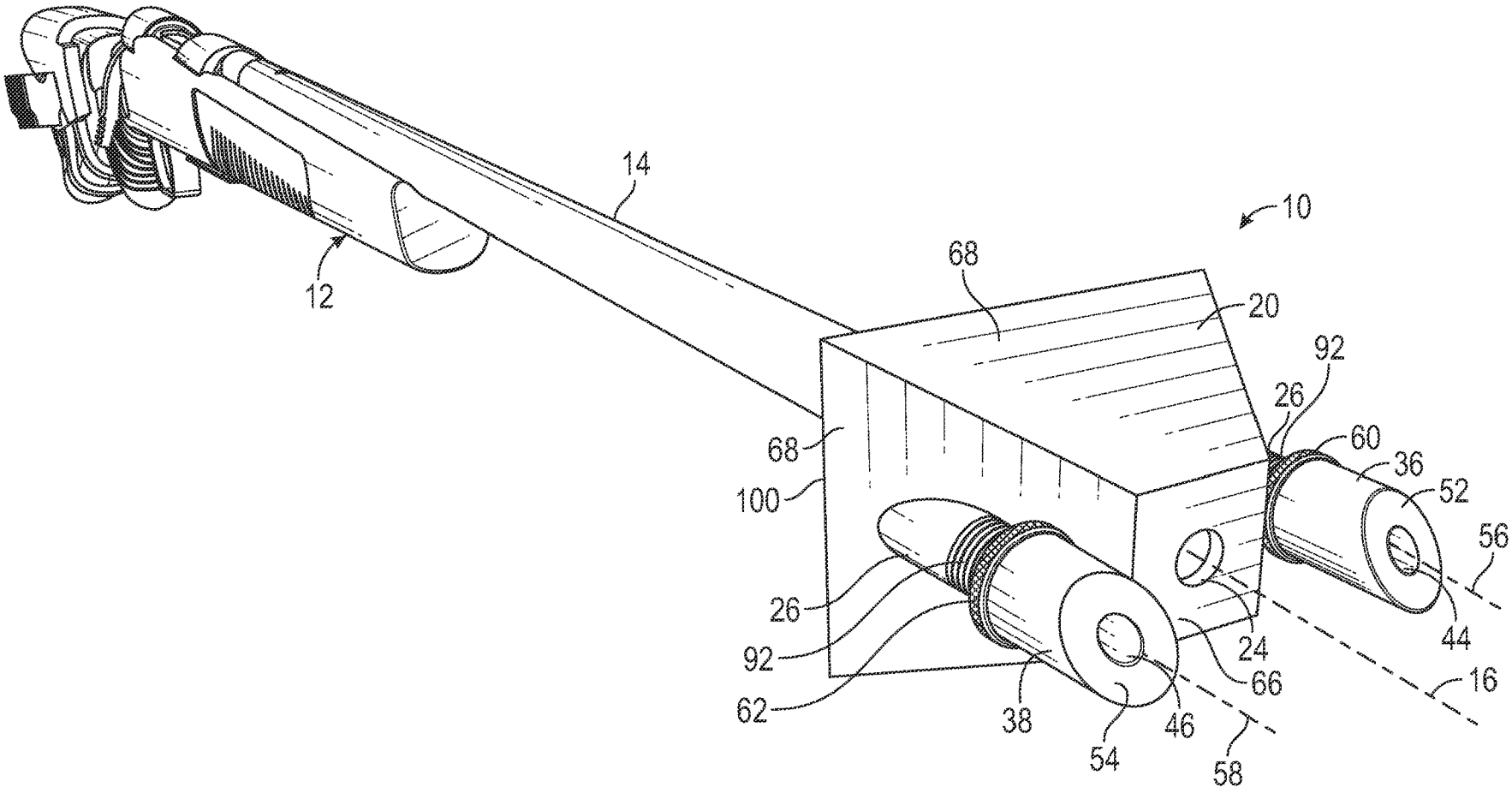
FIG. 1 is a top front isometric view of the current embodiment of a muzzle brake compensator constructed in accordance with the principles of the present invention in use connected to a rifle.

An embodiment of the muzzle brake compensator of the present invention is shown and generally designated by the reference numeral 10.

Figure 2:
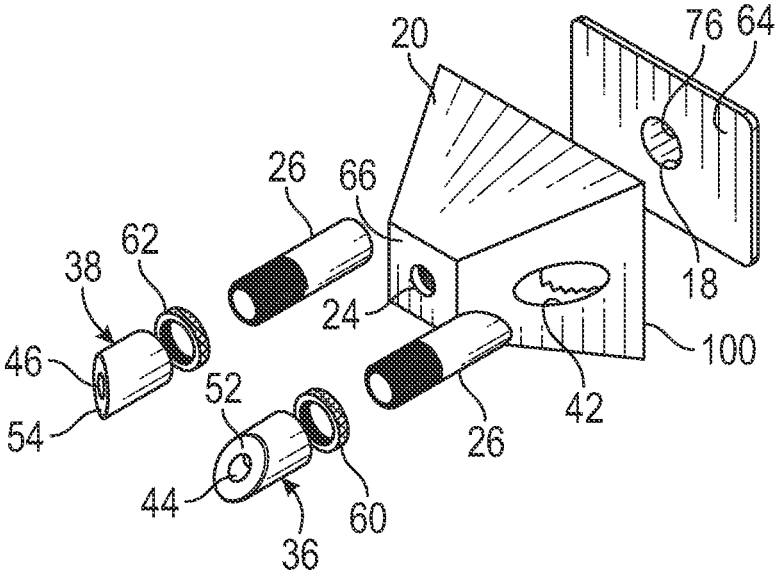
FIG. 2 is an exploded view of the muzzle brake compensator of FIG. 1.
Figure 3A:
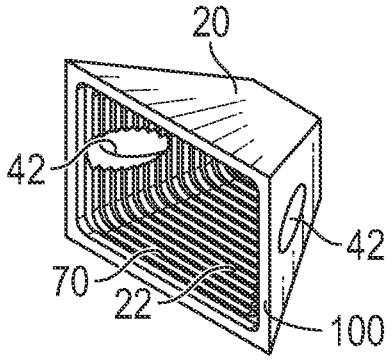
FIG. 3A is a top rear isometric view of the body of FIG. 1.
Figure 3B:
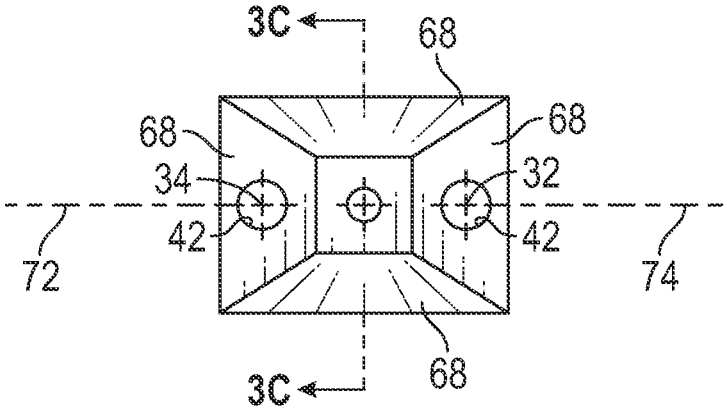
FIG. 3B is a front view of the body of FIG. 1.
Figure 3C:
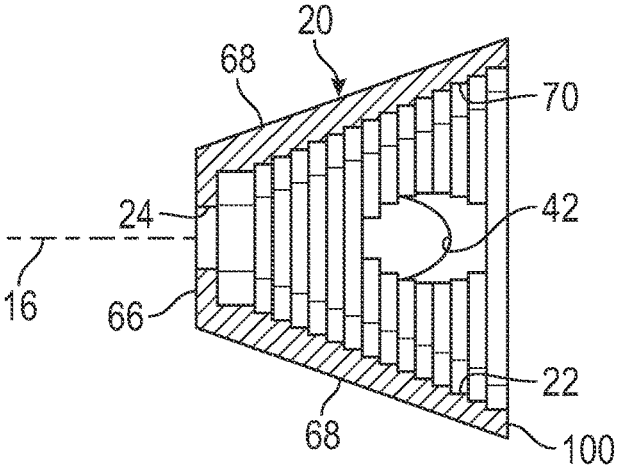
FIG. 3C is a side sectional view of the body of FIG. 1.
Figure 4A:
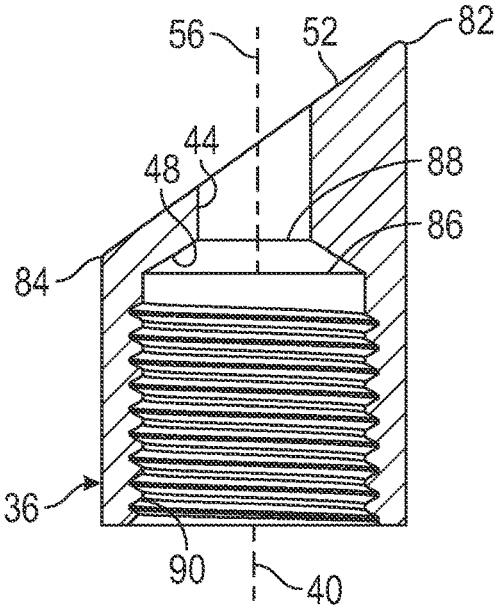
FIG. 4A is a side sectional view of the nozzle element of FIG. 1
Figure 4B:
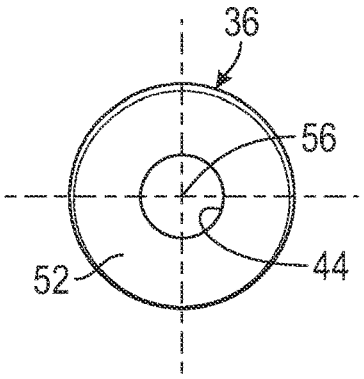
FIG. 4B is a front view of the nozzle element of FIG. 1
Figure 5:
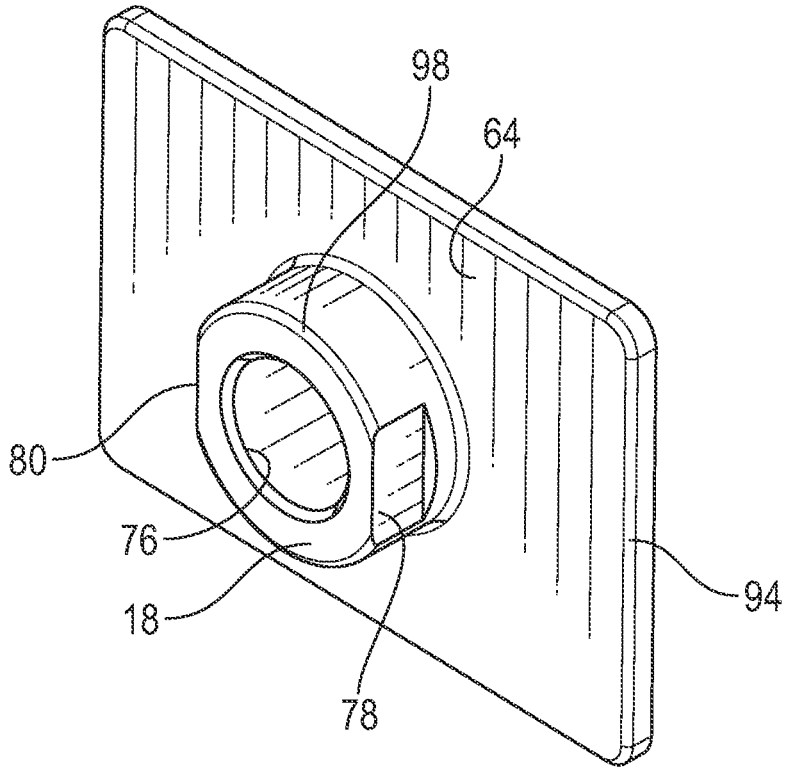
FIG. 5 is a top rear isometric view of the rear panel and mount of FIG. 1.

FIGS. 1 & 2 illustrate the improved muzzle brake compensator 10 of the present invention. FIGS. 3A-C illustrate the improved body 20 of the present invention. FIGS. 4A-B illustrate the improved nozzle element 36 of the present invention, which is identical to nozzle element 38. FIG. 5 illustrates the improved mount 18 and rear panel 64 of the present invention. More particularly, FIG. 1 shows the muzzle brake compensator in use as a muzzle device for a firearm attached to a rifle 12 having a barrel 14 defining a barrel axis 16. The muzzle brake compensator has a mount 18 configured to connect to the barrel in registration with the barrel axis and defining a central bore 76 registered with the barrel axis. The mount includes opposed flats 78, 80 to facilitate installation of the muzzle brake compensator on the barrel using a suitable tool. A body 20 defining an interior chamber 22 is connected to the mount. The body defines a bullet aperture 24 registered with the barrel axis. A pair of exhaust ports 26 is connected to the body spaced apart from the bullet aperture and located on laterally opposed positions with respect to the bullet aperture. The exhaust ports each define different exhaust port axes 32, 34 angularly offset from each other. Each exhaust port axis is laterally offset from the barrel axis by the same amount. The exhaust port axes and the barrel axis define a common horizontal plane 72, and the port axes define a common plane 74.

A nozzle element 36, 38 is connected to each exhaust port 26 and is rotatable about a port axis 40. Each nozzle element defines an exhaust aperture 44, 46 having an exhaust feature 48 having a characteristic angularly offset from the port axis, such that the rotational position of the nozzle element determines a direction of an exhaust force with respect to the port axis. Each nozzle element is capable of being rotated 360° both horizontally and vertically in relation to the weapon muzzle to adjust the directional flow of muzzle gases. Thus, the shooter can adjust the direction of the exhaust force from each nozzle element to decrease muzzle movement. In the current embodiment, each nozzle element protrudes laterally at an angle from the barrel axis and is lateral to the bullet aperture. Each nozzle element includes an end face 52, 54 defining the exhaust aperture, the end face having a normal direction offset from the port axis. Each exhaust aperture defines an exhaust axis 56, 58 angularly offset from the port axis. Each exhaust port is a cylindrical tube receiving a nozzle element that is connected to an exhaust port aperture 42 defined by the body 20. The exhaust ports are externally threaded, and the nozzle elements are internally threaded. A lock nut 60, 62 is received on each of the exhaust ports and is configured to bind against the attached nozzle element. A third lock nut (not shown) can be used to secure the mount 18 to the barrel 14. In the current embodiment, the end faces are angled at 125.97° relative to vertical. The tallest portion of the end faces terminates in a rounded portion 82 having a radius of 0.013 inch and is 0.986 inch tall. The shortest portion of the end faces terminates in an angled portion 84. The exhaust features begin at a height of 0.515 at the widest portion 86 and terminates at a height of 0.582 inch at the narrowest portion 88. The nozzle elements have an outer diameter of 0.620 inch and an internal ½-32 threaded portion 90. The exhaust apertures have a diameter of 0.230 inch. The lock nuts have an outer diameter of 0.703 inch with knurled sides to provide grip, an internal ½-32 threaded portion to threadedly engage the exhaust ports, and a thickness of 0.125 inch. The exhaust ports are 1.620 inch long, are angled at 135.00° from vertical where the exhaust ports connect to the body, and have an externally ½-32 threaded portion 92 at least 0.600 long. However, the exhaust ports are not restricted to the 135.00° angle. The exhaust ports have an internal diameter of 0.370 inch and a cylindrical exterior having a radius of 0.250 inch.

The body 20 includes a rear panel 64 connected to the mount 18, a front panel 66 defining the bullet aperture 24, and four side panels 68 obtusely angled with respect to the front panel. The side panels are also angled facing forward and laterally away from the front panel. In the current embodiment, the body is a frustum shape. The interior chamber 22 is enclosed except for the mount, pair of exhaust ports 26, and bullet aperture. The interior chamber has an articulated surface 70. In the current embodiment, the front panel has a length and width of 1.000 inch, and the rear 100 of the body has a width of 2.250 inch and a width of 3.000 inch. The front panel is spaced apart from the rear of the body by 1.750 inch. The bullet aperture has a diameter of 0.350 inch, and the exhaust port apertures 42 have a diameter of 0.510 inch. The articulated surface consists of a series of steps in the current embodiment. The rear panel has a width of 1.910 inch, a length of 2.655 inch, a thickness of 0.120 inch, and a rear circumferential chamfer 94. The combined thickness of the rear panel and mount at the start of the flats is 0.250 inch, and the combined maximum thickness of the rear panel and mount is 0.500 inch. A circumferential radiused portion 96 having a radius of 0.320 inch connects the mount to the rear panel. An additional circumferential radiused portion 98 having a radius of 0.32 inch is located at the top of the mount. The mount has a cylindrical exterior having a radius of 0.500 inch. The central bore 76 has an internally ⅝-24 threaded portion that is 0.64 inch in diameter and 3/32 inch deep.

It should be appreciated that a nozzle element 36, 38 is an apparatus that is directly connected to an exhaust port. Each nozzle element has an exhaust aperture 44, 46, which is an opening for muzzle gases to enter into, pass through, and an opening for muzzle gases to exit. Nozzle elements are used to direct muzzle gases. The nozzle element is securely attached to the exhaust port either internally or externally. Nozzle elements can be attached to an exhaust port using a variety of methods, including any method of welding, threaded through or with threaded locking devices or methods, and any method of which the nozzle element is turned into the exhaust port and locked securely, including: clips, pinning, set screw or screws, bonding by adhesive or multipart adhesives, and pressure fittings. Different nozzle element designs can be interchanged and used in any combination to make the weapon firing the projectile perform in a way most beneficial for each individual operator. The dimensional size, length, design, thread, and inside diameter of the nozzle elements is dependent on the caliber of weapon, or device that produces a muzzle blast concussion and recoil as a response to firing a projectile, that the nozzle elements will be attached to, by scaling the dimensional size of the nozzle element to appropriately scale to fit the size of the exhaust port that is attached to the body 20. The diameter of the exhaust aperture within the nozzle element may be as wide as the inner diameter of the walls of the tube forming the nozzle element. There may be more than one exhaust aperture in the nozzle element. The nozzle element can be used as secondary nozzles that further reduce recoil. The nozzle element can be designed to utilize the Venturi effect and/or the Bernoulli equation to create a De Lavel nozzle.

As the muzzle gases from the fired projectile enter the interior chamber 22, some of the gases are then forced into the exhaust ports 26, which are volumetrically smaller. After the gases pass through the exhaust ports, they enter the nozzle elements 36, 38, which may have different variations of exhaust aperture 44, 46 sizes, shapes, or placement on the nozzle elements. The purpose for this design is in relation to how the Venturi Effect works.

When a gas or liquid is forced through a pipe that has a smaller cross-section, the static pressure decreases and the velocity increases. The smaller the nozzle element 36, 38 exhaust apertures 44, 46, the higher the velocity at which the exhaust gases exit. The exhaust port 26 itself can increase the velocity of exiting muzzle gases independently of the nozzle element, but by attaching the nozzle element, the velocity of the muzzle gases increases, which explains why there is a need for various nozzle element designs that provide varying exhaust aperture sizes. This also explains why two exhaust ports are effective because the nozzle element ultimately defines the velocity at which the exhaust gases are exiting. For example, a semi-automatic firearm when fired not only has muzzle rise and recoil, but also has the effects of the action. When the bolt slides back then forward again, this action will pull the gun to the right. Pointing the left nozzle element directly upward, will counter muzzle rise. Point the right nozzle element to the right enables the muzzle gases exiting the right nozzle element at a high velocity to counter the action of the bolt moving backwards then forwards, thereby not allowing the firearm to move to the right.

When the present invention is attached to the barrel of a firearm and a projectile is fired this series of events is believed to occur.

1. The projectile exits the barrel and travels inside the body.

2. The propellant gasses are rapidly expanding within the interior body.

3. The interior body provides a pathway or otherwise funnels expanding propellant gasses towards the bullet aperture.

4. Rapidly travelling gases are forced into the interior walls of the body towards the bullet aperture face creating a braking effect or force.

5. At this time, the projectile is entering the bullet aperture.

6. As the projectile passes through the bullet aperture, the widest part of the bullet, up to and including the ogive, occupies the bullet aperture. Pretend the bullet pauses right there.

7. This is the instant in time each part of the present invention is working at its full capacity.

8. The propellant gases continue to expand into the interior walls, reducing the felt recoil on the shooter. While the widest part of the bullet occupies the bullet aperture, the propellant gases naturally travel the path of least resistance. At this time, propellant gases enter into the exhaust ports, which is the pathway to the nozzle elements.

9. At the instant in time which the gases are entering the nozzle element, the propellant gases begin their departure. The direction of the propellant gases is at the discretion of the operator based on the set orientation of the nozzle elements, within reasonability of nozzle element function.

10. As the projectile exits the bullet aperture, the propellant gases once again flow in the path of least resistance, which becomes the bullet aperture because the propellant gases are funneled rapidly out the bullet aperture for quick departure.

When the nozzle elements function as intended, the departing propellant gases will greatly benefit the operator. The direction the propellant gases exit causes an opposite movement of the firearm muzzle. For example, if the muzzle rises the gases should depart upwards to offset the muzzle rise. Muzzle movement is not only caused from propellant gases exiting, but also is influenced by the size of projectile, propellant burn rate, and action movement of the firearm. Muzzle movement is also greatly affected by the physics of how the operator holds the firearm, the pressure with which the operator holds the firearm against their shoulder, the size and weight of the operator, and the location and placement of the buttstock of the firearm in relation to the placement on the operator's shoulder.

Compensating for all of these variables is where the present invention excels. It was designed to not be a one size fits all people muzzle brake compensator. To explain the effects of an operator's size and weight, here are two examples shooting same caliber, bullet weight, etc.:

Operator 1. Weighs 250 lbs. and in average shape. The muzzle would move some due to the size and weight of the operator.

Operator 2. Weighs 120 lbs. smaller stature and in average shape. The muzzle likely would move a considerable amount more due to size and weight of operator.

The present invention allows the operator to change/adjust the nozzle elements. Differing nozzle element designs and exhaust aperture sizes will allow propellant gases to depart at different velocities, which will give the operator the ability to correct muzzle movement in any direction whether it is caused by the size, weight, stature, or shooting style of the operator, propellant gases exiting, size of the projectile, propellant burn rate, or the action movement from a firearm, including semi-auto.

In the first of a series of tests, the body of the muzzle brake was a 3-inch-wide tube attached perpendicularly to the barrel with four exhaust ports extending outwardly with fixed and rotatable nozzles. In second and third tests, the body of the muzzle brake was a tapered tube that was 3 inches wide at the point where it attaches to firearm and 1 inch wide in the front where the bullet aperture was located. One design using the tapered tube had four exhaust ports extending outwardly with rotatable nozzles. A second design using the tapered tube had two exhaust ports extending outwardly with rotatable nozzles. Subsequent tests used muzzle brake bodies shaped as polyhedrons, including the frustrum described previously.

The conclusion was each geometric body shape performed remarkably the same. The two tubular body designs had a smooth interior chamber of the body, while the frustrum has an interior chamber with an articulated surface. The performance remained remarkably the same while firing a firearm with each body shape that included a body with exhaust ports attached to the body that extended outward with connecting adjustable/interchangeable nozzles.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a muzzle brake compensator has been described in detail, it should be apparent that modifications and variations thereto are possible, all of which fall within the true spirit and scope of the invention. Although rifles have been disclosed, the muzzle brake compensator is also suitable for use with smooth bore and rifled shotguns, light and medium machine guns, and other firearms. Furthermore, the size of the exhaust ports and exhaust apertures can be varied to increase or decrease the flow of muzzle gases to achieve desired performance characteristics for a given caliber or type of firearm used. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A muzzle device for a firearm having a barrel defining a barrel axis, the muzzle device comprising:

a mount configured to connect to the barrel in registration with the barrel axis;

a body defining an interior chamber and connected to the mount;

the body defining a bullet aperture registered with the barrel axis;

an exhaust port connected to the body apart from the bullet aperture and extending forwardly away from the mount;

a nozzle element connected to the exhaust port and rotatable about a port axis; and the nozzle element defining an exhaust aperture having an exhaust feature having a characteristic angularly offset from the port axis, such that the rotational position of the nozzle element determines a direction of an exhaust force with respect to the port axis.

2. The muzzle device of claim 1 wherein the nozzle element protrudes laterally at an angle from the barrel axis.

3. The muzzle device of claim 1 wherein the nozzle element is lateral to the bullet aperture.

4. The muzzle device of claim 1 including a pair of exhaust ports.

5. The muzzle device of claim 4 wherein the exhaust ports are located on laterally opposed positions with respect to the bullet aperture.

6. The muzzle device of claim 4 wherein the exhaust ports each define different exhaust port axes angularly offset from each other.

7. The muzzle device of claim 6 wherein each exhaust port axis is laterally offset from the barrel axis by the same amount.

8. The muzzle device of claim 6 wherein the exhaust port axes and the barrel axis define a common horizontal plane.

9. The muzzle device of claim 6 wherein the exhaust port axes define a common plane.

10. The muzzle device of claim 1 wherein the body includes a rear panel connected to the mount, a front panel defining the bullet aperture, and side panels obtusely angled with respect to the front panel.

11. The muzzle device of claim 1 wherein the body includes a rear panel connected to the mount, a front panel defining the bullet aperture, and side panels angled facing forward and laterally away from the front panel.

12. The muzzle device of claim 1 wherein the body is a frustum shape.

13. The muzzle device of claim 1 wherein the nozzle element includes an end face defining an exhaust aperture, the end face having a normal direction offset from the port axis.

14. The muzzle device of claim 1 wherein the exhaust aperture defines an exhaust axis angularly offset from the port axis.

15. The muzzle device of claim 1 wherein the interior chamber is enclosed except for the mount, exhaust port, and bullet aperture.

16. The muzzle device of claim 1 wherein the interior chamber has an articulated surface.

17. The muzzle device of claim 1 wherein the exhaust port is a cylindrical tube receiving the nozzle element.

18. The muzzle device of claim 17 wherein the exhaust port is externally threaded and the nozzle element is internally threaded.

19. The muzzle device of claim 18 including a lock nut received on the exhaust port and configured to bind against the nozzle element.

20. A muzzle device for a firearm having a barrel defining a barrel axis, the muzzle device comprising:

a mount configured to connect to the barrel in registration with the barrel axis;

a body defining an interior chamber and connected to the mount; the body defining a bullet aperture registered with the barrel axis;

an exhaust port connected to the body apart from the bullet aperture;

a nozzle element connected to the exhaust port and rotatable about a port axis;

the nozzle element defining a gas passage along a passage axis coaxial with the port axis; and the nozzle element defining an exhaust aperture having an exhaust feature having a characteristic angularly offset from the port axis, such that the rotational position of the nozzle element determines a direction of an exhaust force with respect to the port axis.

21. The muzzle device of claim 20 wherein the exhaust port and the nozzle are cozxial tubular structures.

22. The muzzle device of claim 20 wherein the nozzle defines a first interior passage diameter and defines a nozzle exit aperture smaller than the first interior passage diameter.

* * * * *